United States Patent [19]

Gertsch et al.

[11] Patent Number: 4,917,012

[45] Date of Patent: Apr. 17, 1990

[54] INKING DEVICE FOR PRINTING PRESS AND AN INKING DOSING MEMBER CONSTRUCTION

[75] Inventors: Peter Gertsch, Niederscherli; Robert Imhof; Eugen Zwahlen, both of Bern, all of Switzerland

[73] Assignee: Maschinenfabrik Wifag, Bern, Switzerland

[21] Appl. No.: 190,338

[22] Filed: May 5, 1988

[51] Int. Cl.[4] ..... B41F 31/04; B41L 27/06

[52] U.S. Cl. ..... 101/363; 101/350

[58] Field of Search ..... 101/350, 363, 365, 349, 101/148, 207, 208, 209, 210; 118/261, 262

[56] References Cited

U.S. PATENT DOCUMENTS

| | | | |
|---|---|---|---|
| 3,087,184 | 4/1963 | Ljungquist | 101/169 X |
| 3,245,377 | 4/1966 | Gettel | 101/350 |
| 3,283,712 | 11/1966 | Chambon | 101/350 |
| 3,559,572 | 2/1971 | Hackley | 101/350 |
| 3,730,087 | 5/1973 | Trant et al. | 101/169 |
| 4,211,167 | 7/1980 | Corse | 101/365 |
| 4,357,872 | 11/1982 | Simeth et al. | 101/365 |
| 4,455,938 | 6/1984 | Loudon | 101/148 |
| 4,590,857 | 5/1986 | Dahlgren | 101/350 |
| 4,699,055 | 10/1987 | Jeschke | 101/350 |

FOREIGN PATENT DOCUMENTS

| | | | |
|---|---|---|---|
| 210133 | 1/1987 | European Pat. Off. | 101/363 |

*Primary Examiner*—J. Reed Fisher

*Attorney, Agent, or Firm*—McGlew & Tuttle

[57] ABSTRACT

The inking device of a printing machine is composed of an inking roller, providing an elastic surface, the inking roller producing a pre-dosed ink layer on the inking rollers. A dosing strip wipes off the pre-dosed ink layer and leaves the quantity necessary for the transfer onto a stereo cylinder, the wiped off excess ink running off freely. For self-cleaning purposes, the dosing strip carries out a movement preferably in the direction of the circumference of the inking roller, so that the area forming the dosing slot which is in contact with the inking roller is continuously modified.

20 Claims, 9 Drawing Sheets

INKING DEVICE FOR PRINTING PRESS AND AN INKING DOSING MEMBER CONSTRUCTION

BACKGROUND OF THE INVENTION

1. Field of the Invention The invention relates, in general, to printing machines and, in particular, to a new and useful inking device for a printing press, comprising at least one stereo cylinder bearing a printing block, one inking roller with an elastic surface which can be joined to the stereo cylinder, an inking device, which inks up the inking roller and a dosing device which can be joined to the inking roller. A similar arrangement is known from the German Publication No. 32 25 982. Here the ink is transferred from an inkwell onto the inking roller covered by an elastic surface, the inkwell being, defined by a wall holding back the ink on the one side, and by a dosing member on the other side. The dosing member, being joined virtually tangential to the inking roller produces on the inking roller a thin ink layer suitable for the transfer onto the stereo cylinder. Hence, it holds back the ink in the inkwell except for the quantity guided through the slot between dosing member and inking roller. Since the quantity of ink carried off is very small, the ink supply lasts very long in the inkwell.

By reason of the relatively large resting or supporting surface of the dosing member, a huge hydrodynamic pressure is built up in the ink slot. In order to obtain a sufficiently thin and constant ink layer, the dosing member has to be pushed with a large a mount of power against the elastic surface of the inking roller. This high power (engagement power) causes a high strain of the elements taking part in the dosing process, which entails a high wear of these elements. It has to be noted that along with an increasing strain of these elements, an extreme heating up, especially of the ink, is caused. The ink heats up particularly in the region of the edge of the dosing member, since the ink supply is carried off from the dosing slot very slowly. This rise of temperature can be followed by a change of the property of the ink, which affects the printing quality immediately. Cooling devices of correspondingly huge dimensions are supposed to keep the heating under control.

As a consequence of the pushing pressure acting on the dosing member, necessary for the hydrodynamic pressure of the ink in the dosing slot, and, as a consequence of the virtually tangential joining of the dosing member to the inking roller, there is an additional danger that the front edge of the dosing member can be torn into the inking roller by reason of the elastic fashioning of the surface of the inking roller. This is especially likely to happen when there is a lack of ink, and can cause very severe damage to the entire printing press.

The turbulence occurring in the inkwells which is intended to keep the edge of the dosing member free from dirt substances certainly causes disturbances in the ink layers has to provide a high evenness. This turbulence, however, does not exclude reliably all pollution of the edge of the dosing member. However, the dirt substances clinging to the edge of the dosing member have the effect that the ink layer on the inking roller shows stripes, which are transferred onto the plate cylinder in spite of the ink supply swing rollers and thus can be seen on the printed copy. If no measures are taken these dirt substances remain clinging on the edge of the dosing member and influence the printing quality negatively, until the dosing member is cleaned.

Other attempts to produce an ink layer on an inking roller having an elastic surface by means of a single dosing element, such as with the ink layer providing all the necessary conditions for the transfer onto the stereo cylinder, have failed substantially because of the pollution problems which occur. For this reason, none of the solutions suggested so far could be accepted in general.

SUMMARY OF THE INVENTION

The present invention provides an inking device with as few rollers as possible and which transfers an ink layer, which has been produced directly on the elastic surface of the inking roller providing an elastic surface, onto a printing block carried on a stereo cylinder. The evenness of the ink layer is guaranteed during the printing procedure without exposing the inking rollers which provides an elastic surfaces to too much strain. This wear and the heating can be kept very low. At the same time the dosing element is supposed to eliminate the interfering dirt substances at the dosing edge.

In accordance with the invention, the inking device produces a pre-dosed ink layer on the inking roller and the dosing device is composed of at least one dosing strip, which wipes off the pre-dosed ink layer on the inking roller and leaves the necessary quantity for the transfer onto the stereo cylinder. The excess ink wiped off by the dosing strip runs off freely. The dosing strip is attached in such a way that at least the part forming the dosing slot can be moved or oscillated for self cleaning purposes. Preferably, the movement is made in the direction of the circumference of the inking roller, so that continuously another region of the dosing strip forms the dosing slot with the inking roller.

The oscillating movement of at least one part of the dosing strip to a small extent avoids very efficiently an accumulation of dirt substances and keeps them from clinging to the edge of the dosing strip, because the region of the dosing strip which is in action is changing all the time. Thus the polluting substances are continuously washed away by the excess ink wiped off by the dosing strip and by the dosed ink layer itself, so that a formation of stripes on the inking roller can be excluded.

Turbulences, which could affect the dosed ink layer are substantially avoided because only an ink layer which is predosed in the inking roller comes to the dosing strip and because the excess ink can flow off without a problem. This excess ink is collected advantageously by an accumulator tank and either is guided to an ink treating installation and then back to the inking device, or directly back to the inking device. By the choice of suitable dimensions of the pre-dosed ink quantity, carried out by the inking device, and by the fact that the ink remains for a very short time in the inking device, neither the ink nor the elements taking part in the production and dosage of the final ink layer are excessively heated up, so that an additional cooling becomes unnecessary.

This inking device avoids also the so called "ghost images" on the printed product. The inking device produces continuously a new ink layer on the inking roller reduced to the necessary quantity by the strip and then is transferred to the printing block. Thus the inking device can provide another, preferably smaller diameter than the stereo cylinder.

As a further improvement of the invention and the above measures, the oscillating movement of the dosing strip in the direction of the circumference of the inking roller can be obtained advantageously by providing a cylindrical dosing edge for the dosing strip and by fashioning the dosing strip swingable around the axis of the cylinder defined by the cylindrically rounded edge. The positioning of the dosing strip is carried out suitably by providing the trunnions disposed on the front sides of the dosing strip, the axis of rotation of which coincides with the axis of the cylinder defined by the cylindrically rounded edge. Thus it is guaranteed that the thickness of the dosing slot and the shape of the dosing slot stay exact when the dosing strip is swung.

A further advantageous development of the features of the invention can be carried out by connecting the dosing strip flexibly with two parallel control levers. These two control levers are articulated to two levers which are parallel to the dosing strip. The rocking levers are kept in their one end in stationary bearings. The turning points of the stationary bearings and the turning point of the axis of rotation of the dosing strip is disposed on one straight line. Thus no bearings have to be set up in the immediate surroundings of the surface of the inking roller. Furthermore several dosing strips can be disposed over the width of the inking roller. The adjustment of the dosing slot between inking roller and dosing strip is carried out in an easy way by the fact that one of the stationary bearings of a rocking lever is adjustable around the other stationary bearing of the other rocking lever by corresponding means.

In order to protect the very precisely treated dosing edge of the dosing strip, this dosing edge can be covered advantageously with a supple plate like a foil, which is attached in such a way, that it can be easily exchanged.

The movement of the area of the dosing strip forming the dosing slot can be carried out by moving the foil chucked over the dosing strip in the direction of the circumference of the inking roller oscillating to an fro. This has the advantage that the dosing strip can be disposed stationary.

In the case of all these described embodiments it is possible to dispose in the known way several dosing strips and inking rollers being several pages wide next to each other for printing presses which are several pages wide. This arrangement side by side renders possible an ink separation over the width of a whole page without a problem.

Accordingly, it is an object of the invention to provide a dosing strip which is engageable with an inking roller and which comprises a substantially wedge-shaped member having a surface with a portion which is rounded and which may be selectively engaged with an elastic surface of an inking roller over a varied arcuate range by moving the dosing strip.

A further object of the invention is to provide a dosing strip for engagement with an inking roller having an elastic surface which comprises a wedge-shaped member and means for engaging a stretching strip over the member which is positioned to engage over a rounded portion and which may be varied by either rotating the strip member or varying the position in which the strip material over the wedge-shaped member is engaged with the elastic surface of an inking roller.

A further object of the invention is to provide a printing press arrangement which includes an inking roller which has an elastic surface which is rotated in an ink supply to pick up a pre-dosed ink layer on the inking roller and which comprises a dosing strip which has a curved surface engageable with the inking roller and which is mounted by means which permit it to be moved so that the curved surface thereof varies its position of contact with the inking roller.

A further object of the invention is to provide an inking device which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
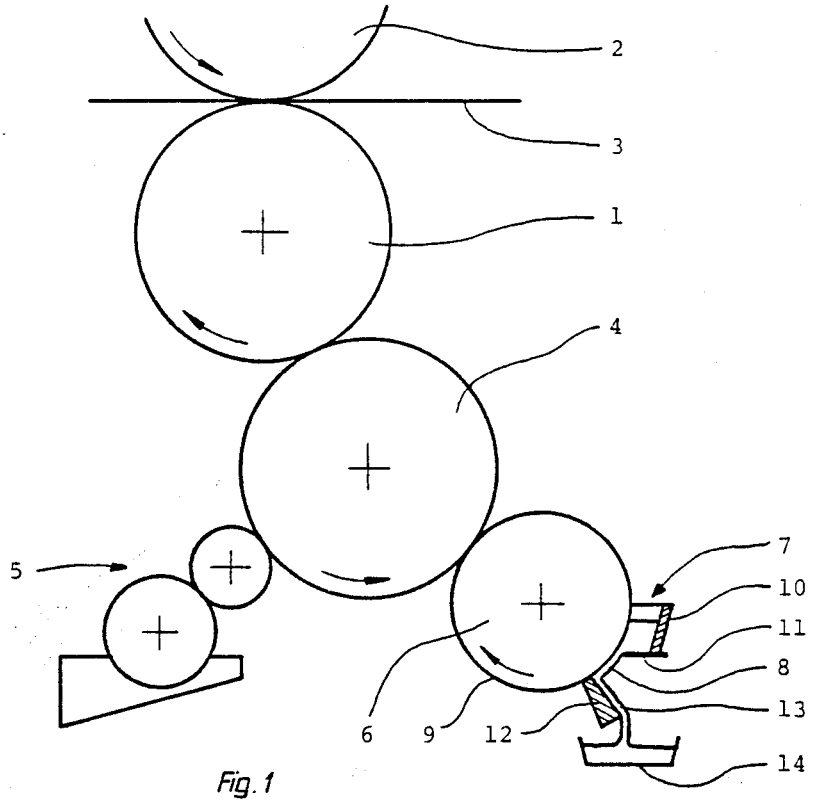
FIG. 1 is a schematic view of a printing press of an offset rotation printing machine constructed in accordance with the invention and comprising an inking device and a damping device.

Referring to the drawings, in particular, the invention embodied therein comprises an inking device for a printing press which includes a rubber blanket cylinder 1 and stereo cylinder 4 which are in rotating engagement and with an inking device which picks up ink and delivers it to an inking roller 6 which, in turn, transfers it to a printing block of a stereo cylinder 4.

The printing press which is represented diagrammatically in FIG. 1 is composed of one rubber blanket cylinder 1, to which a counter pressure cylinder 2 is joined, which can be fashioned as a further rubber blanket cylinder.

The web of paper 3 to be printed is lead between the rubber blanket cylinder 1 and the counter pressure cylinder 2 and is printed. A stereo cylinder 4, bearing printing blocks is joined to the rubber blanket cylinder 1. A diagrammatically represented known damping device 5 is attached to this stereo cylinder 4, the damping device transferring the damping means onto the printing blocks. An inking roller 6, which provides an elastic surface, is in contact with the plate cylinder 4 as well. On this inking roller 6 a pre-dosed ink layer 8 is produced by an inking device 7 over the whole width of the inking roller, the ink layer showing a constant quantity, the thickness of the ink layer 9 which is to be transferred onto the stereo cylinder 4. The inking device 7 of the present embodiment is composed of one inkwell 10 providing an ink measuring instrument 11 which is adjustable in the known way.

Other devices are conceivable, which are known, and which can produce a pre-dosed ink layer onto an inking roller 6. The pre-dosed ink layer 9 which is taken by the inking roller 6 is wiped off by a dosing strip 12, which is inserted after the inking device 7. Thus the ink layer 9, which can be transferred onto the stereo cylinder 4 is produced. The excess ink 13, which has been wiped off by the dosing strip runs off freely into an accumulator tank 14, from which the accumulated ink is guided directly into the inking device 7 or in an ink treatment installation, which is not shown and from there it is pumped back into the inking device 7.

The ink layer 9, which can be transferred onto the stereo cylinder 4 shows an even thickness over the entire width of the inking roller 6. This thickness can be adjusted by a stronger or less strong joining of the dosing strip against the inking roller 6, which can be effected by known adjusting mechanisms, which are represented in FIG. 3, for example.

The inking device 7 produces continuously a newly pre-dosed ink layer 8 on the inking roller 6, so that the inking roller, which rotates with the same circumference speed as the stereo cylinder 4 can provide another, preferably a smaller diameter than the stereo cylinder 4, without incurring the risk of producing the so called "Ghost images".

Figure 2:
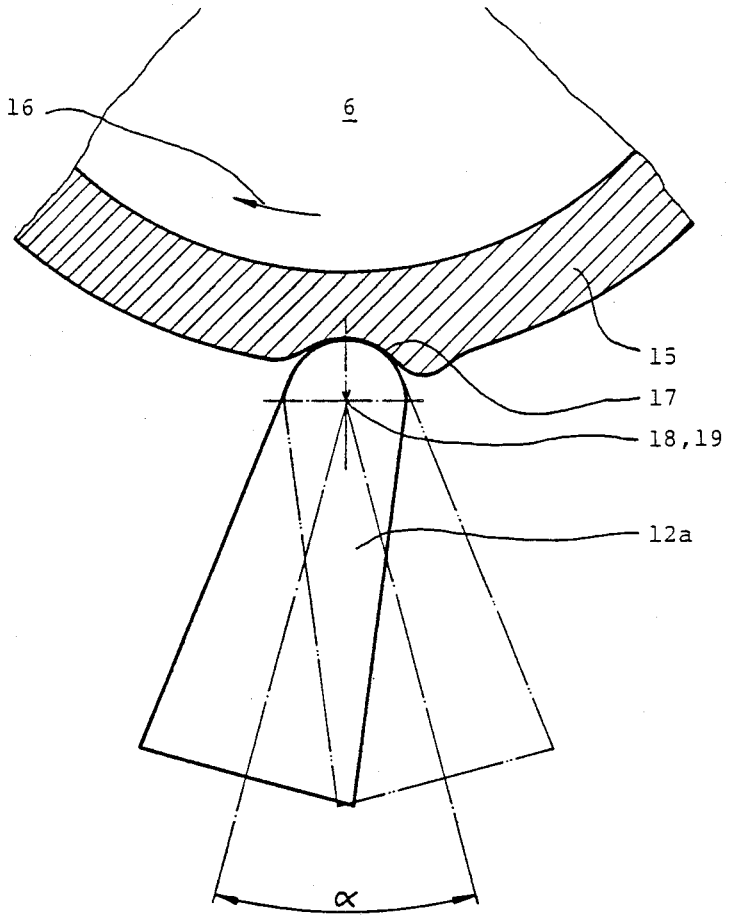
FIG. 2 is a schematic view of a swingable dosing strip constructed in accordance with the invention.

FIG. 2 shows a part of the inking roller 6, which is in contact with the dosing strip 12*a*. The inking roller 6 has an elastic coating 15 and rotates in the direction of arrow 16. The dosing strip 12*a* has an edge 17, which faces the inking roller 6 and has a cylindrical surface. The axis 18 of this cylindrical surface is also the axis of rotation 19, around which the dosing strip 12*a* swings by the angle alpha.

Figure 3:
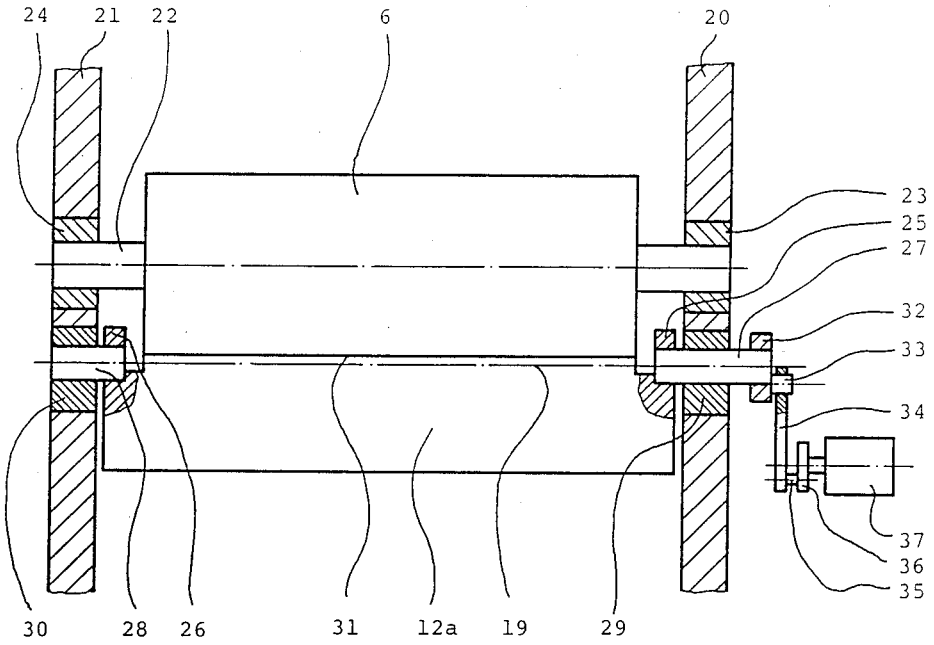
FIG. 3 is a schematic view of a bearing and operating mechanism of the dosing strip of FIG. 2.

FIG. 3 shows how the dosing element 12*a* can be disposed in a printing press. The inking roller 6 is disposed between two lateral walls 20 and 21 of the printing machine. The axis 22 of the inking roller is rotatable in two bearings 23 and 24, which are attached to the lateral walls 20 and 21. The dosing strip 12*a* provides at each of its ends at the front side, a cover plate 25 or 26, in which the bearing pins 27 and 28 are attached stiff against torsion. The bearing pins 27 and 28 are disposed rotatable in the eccentrics or offset bearings 29 and 30. The eccentrics 29 and 30 are disposed in the lateral walls 20 or 21 in such a way, that they can be rotated and fixed in the new position closer to or further away from the inking roller 6. Thus the dosing slot 31, which is formed by the inking roller 6 and the dosing strip 12*a* can be adjusted.

The bearing pin 27 extends out beyond the lateral wall 20. On this extension a lever 32 is disposed fixed against rotation. The lever 32 is connected flexibly with a guide rod 34 by means of a bearing pin 33. The guide rod 34 is rotatably connected by its other end onto a bolt 35, which is fixed in a disk 36, which is rotated by a motor 37. The bolt 35 provides a selective distance to the center of rotation of the disk 36, and this determines the angle alpha (FIG. 2), around which the dosing strip 12*a* is swingable. The rate of revolutions of the motor 37 determines the frequency with which the dosing strip 12*a* moves.

Figure 4:
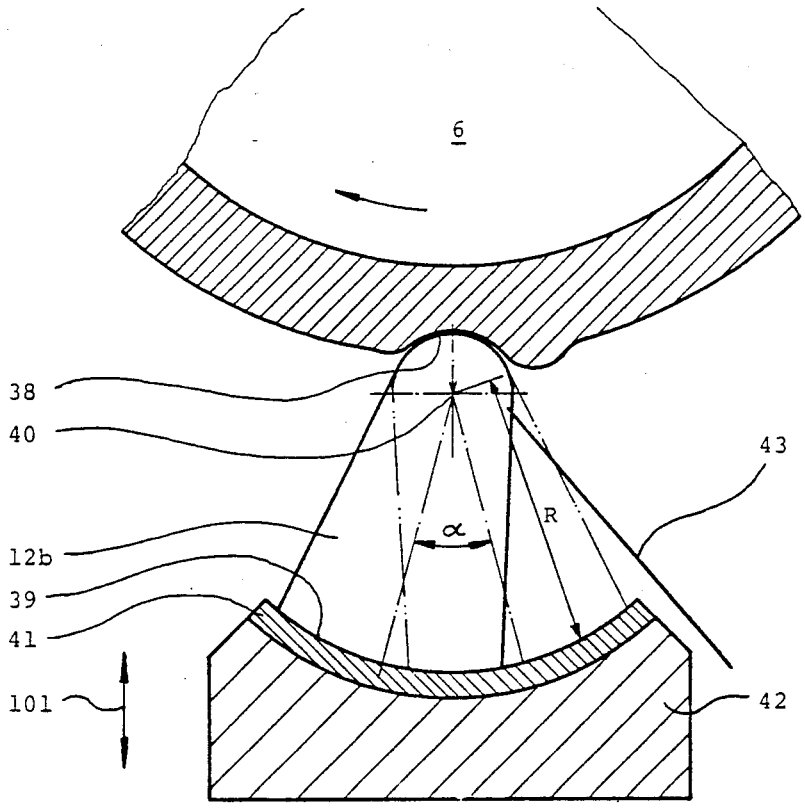
FIG. 4 is a cross-sectional view of a bearing of the dosing strip on a bearing carrier of another embodiment of the invention.

A further possibility to dispose the dosing strip 12 as shown in FIG. 4. The dosing strip 12*b* has an edge facing the inking roller 6 which has an elastic surface, e.g. a cylindrical surface. This dosing strip is fashioned cylindrical at the side 39 averted from the inking roller 6, the distance R between the side and the axis of rotation 40 of the strip being constant. The dosing strip 12*b* lies with its cylindrical fashioned side 39 on a correspondingly shaped bearing element 41, which is attached on a bearing carrier 42. The bearing element 41 is advantageously a friction bearing. The dosing strip 12*b* can be moved to and fro on the bearing element 41 by a drive 41*a* connected to the strip 12*b* at a spaced location from the center 40. In the course of this the dosing strip carries out a swinging movement with the cylindrical fashioned side 39, the center of rotation of which lies in the axis of rotation 40. In order to avoid the bearing element 41 from being polluted, the dosing strip 12*b* has a protecting sheet 43, which drains off the ink which has been wiped off by the dosing strip 12*b* around the bearing element 41. In FIG. 4 the two extreme positions of the swingable dosing strip 12*b* are represented (left: drawn line, right: dotted line). In order to be able to modify the dosing slot in this case, the bearing carrier 43 provides means which allow a lifting and lowering of the bearing carrier 42, as shown by the arrow 101.

Figure 5:
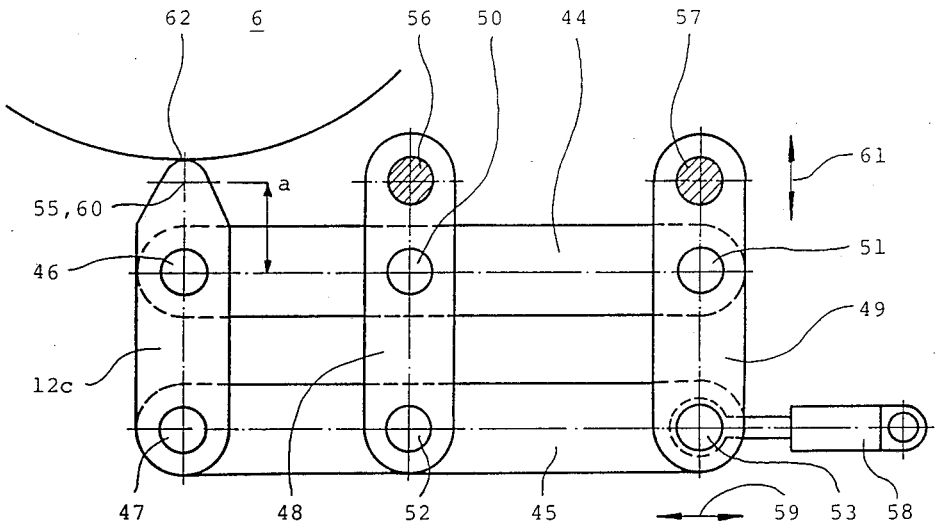
FIG. 5 is a partial sectional and elevational view of a bearing of the dosing strip by means of rocking levers and guide rods of another embodiment.

A further possibility to position the dosing strip 12 is shown in FIG. 5. Respectively two guide rods 44 and 45 are joined to the two front faces at the dosing strip 12*c*, which extends at least over an area along a generatrix surface line of the inking roller 6, the guide rods being attached by means of hinge pins 46 and 47. Guide rod 44 and 45 are connected each flexibly with two rocking levers 48 and 49 respectively, so that the guide rod 44 forms the link 50 with the rocking lever 48, and forms the link 51 with rocking lever 49, and guide rod 45 forms with the rocking lever 48 the link 52 and with the rocking lever 49 the link 53. Guide rod 44 is parallel to the guide rod 45. Rocking lever 48 and rocking lever 49 are parallel to the dosing strip 12*c*. The dosing strip 12*c* provides an edge 54 facing the inking roller 6 having a cylindrical surface and a cylinder axis 55 which is defined in this way. The cylinder axis 55 provides a distance from the link 46. Rocking lever 48 and rocking lever 49 are extended upwards in FIG. 5. At these extensions bearings are disposed, which are overplugged rotatable onto stationary axis 56 and 57. Axis 56 provides also the distance a from the link 50, and axis 57 from link 51 likewise. A pneumatical cylinder is attached to the link 54 in such a way that the rocking lever 49 can be put into a swinging movement around axis 57, as shown by arrow 59. This movement is transferred to the rocking lever 48 and the dosing strip 12*c* through the guide rods 44 and 45. In the course of this the dosing strip turns around the axis of rotation 60, which coincides with the cylinder axis 55. The attachment of the axis 57 can be carried out in such a way, that its position can be slidable by axis 56, as shown by arrow 61, and which can be fixed in the new position. Through this displacement of the axis 57 by axis 56 the width of the dosing slot 62 between dosing strip 12*c* and the inking roller 6 can be adjusted.

Figure 6:
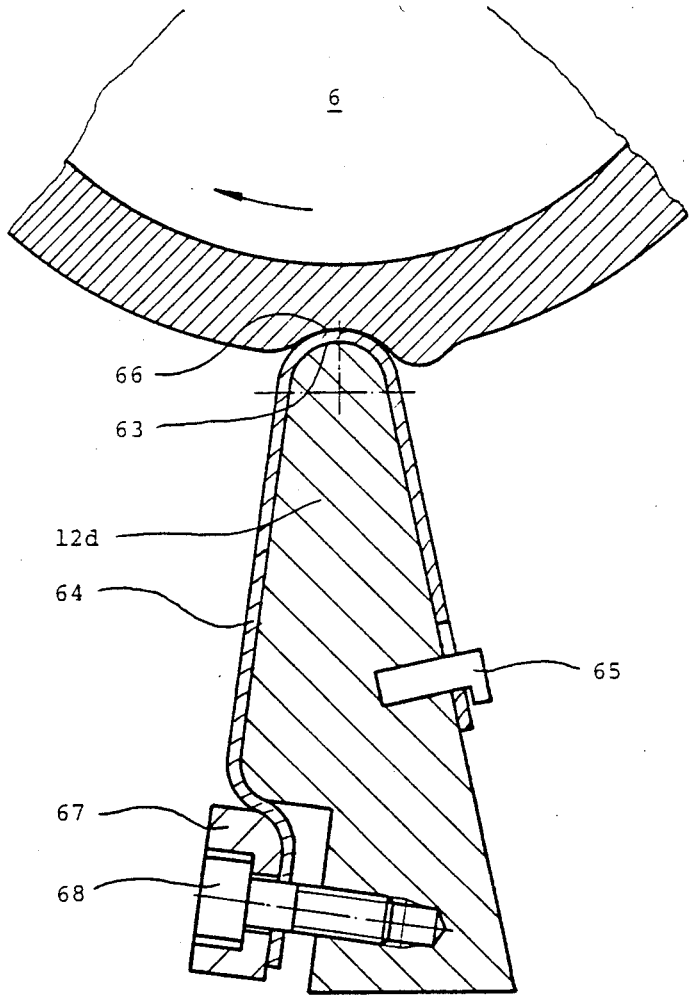
FIG. 6 is a cross-section of a dosing strip providing a protective coating and constructed according to the invention.

In order to avoid that the edge 63 of the dosing strip **12*d* facing the inking roller 6 has to be treated very delicately and could be destroyed by wear, the dosing strip 12*d* can provide a protective coating 64 as shown in FIG. 6 the protective coating is made up of a supple plate, fashioned like a foil and is cased in on the one side of the dosing strip 12*d* into a number of lifting cogs 65 which are dispersed over the width of the dosing strip, and the protective coating is chucked over the edge 63 which forms the dosing slot 66 and is stretched tightly on the other side of the dosing edge 12*d* with a stretching strip 67 by screws 68, which are dispersed over the entire width of the dosing strip 12*d* If there is a too strong wear, the protective coating 64 has to be exchanged, the dosing strip 12*d*** has not to be exchanged. This avoids additional costs for spare parts.

Figure 7:
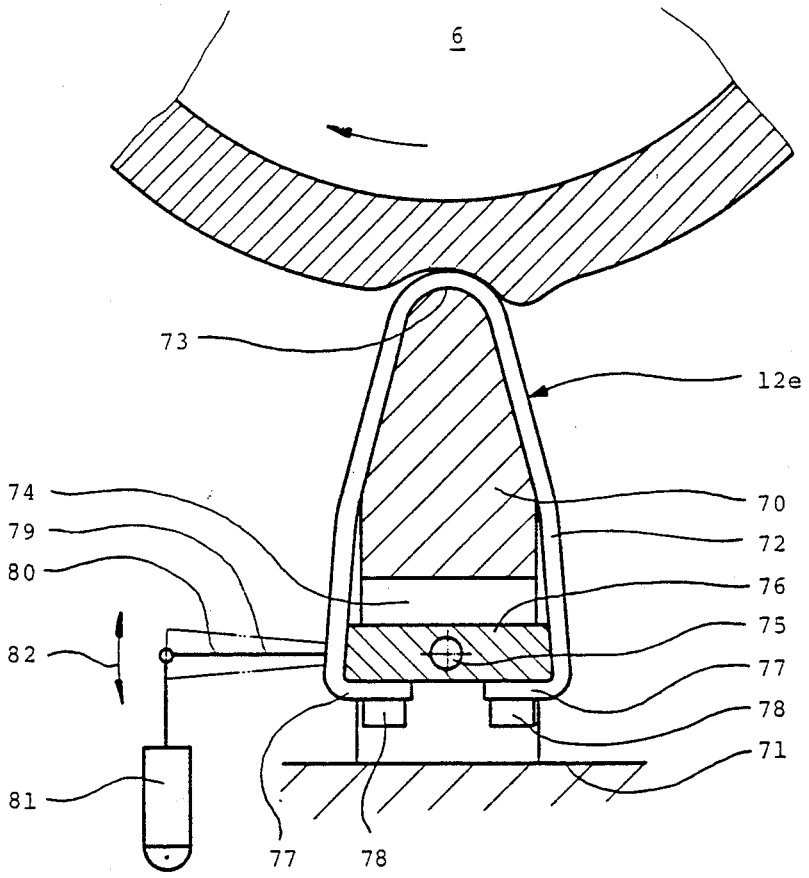
FIG. 7 is a cross-section of a dosing strip of another embodiment equipped with an oscillating, supple plate which can be moved to and fro and is fashioned like a foil.

Another possibility to move the area of the dosing strip **12*e* which forms the dosing slot 12*e* is represented in FIG. 7. The dosing strip 12*e* is composed of a supporting element 70, which is attached to a stable base 71 and a supple plate 72, fashioned like a foil, which is stretched over the supporting element 70. The edge 73 of the inking roller 6 provides a curved shape. In the supporting element 70, disposed over its width, grooves 74 are worked in. On a continuous shaft 75 which is disposed in the flanges remaining between the grooves 74, whipping elements 76 are disposed stiff against rotation. The supple plate 72, fashioned like a foil provides cover plates 77 on both sides, which are attached to a pivotal element 76 by means of screws 78. A lever 79 is also attached to the shaft 75, fixed against rotation. On its side averted from the shaft 75 it is joined to a pneumatic cylinder 81, which transfers an oscillating swinging movement onto the whipping elements 76 through the lever 79, as shown by the arrow 82. Thus the supple plate, fashioned like a foil is moved oscillating to and fro over the edge 73 facing the inking device 6**.

Figure 8:
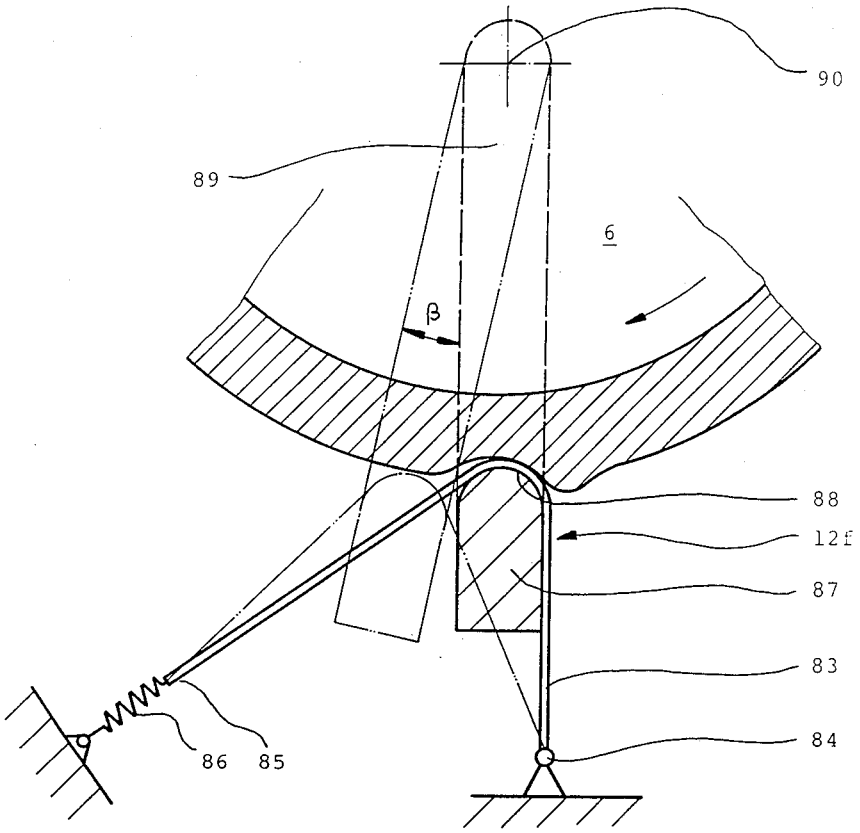
FIG. 8 is a cross-section of another embodiment of dosing strip through a supporting element which can be swung around the axis of the inking roller comprising a supple plate fashioned like a foil.

In addition to the embodiment shown in the FIG. 7, FIG. 8 shows a dosing strip **12*f* which provides a supple plate fashioned like a foil, which in its one end 84 is held stationary, the other end 85 being held by elastic stretching means 86. A supporting element 87, over the edge 88 facing the inking roller 6 of which the supple plate 83 fashioned like a foil is fixed on the front sides of the inking roller 6 at one rocking lever 89 respectively, the rocking levers being attached flexibly to the axis of rotation 90 of the inking roller 6. The bar formed by the rocking lever 89 and the supporting element 87 is swung oscillating around the axis of rotation 90 of the inking roller 6 by an angle alpha by means, which are not represented. This contributes as well to the object that the area of the supple plate which is fashioned like a foil and forms the dosing slot is continuously modified. In FIG. 8** two final position of the swinging movement are represented: The position on the left is represented in dotted lines, the position on the right is represented in drawn lines.

Figure 9:
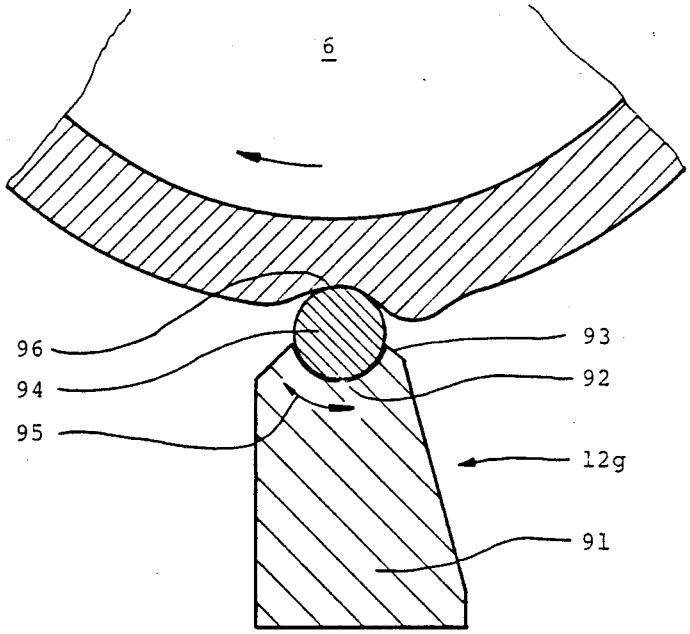
FIG. 9 is a cross-section through a dosing strip, composed of a bearing carrier and a pivotable rod.

In FIG. 9 the dosing strip **19*g* is composed of a bearing carrier 91, which provides a cavity 92 which forms a bearing shell, disposed on the edge 93 facing the inking roller 6. In this cavity 92 a cylindrical rod 94 is positioned rotatable. the cylindrical rod 94 can be put into a rotating or an oscillating movement by non represented means, as shown by the arrow 95. This also contributes to the object that always another area of the cylindrical rod 94 forms the dosing slot 96** together with the inking device.

Experiments have shown that good printing results are obtained, if the cylindrically fashioned surface of the dosing strip 12 which forms the dosing slot provides a radius of about 0.3–1.5 mm. It has been stated as well, that in the case of a modification of the pushing pressure of the dosing strip 12 onto the inking roller 6 the thickness of the ink layer is modified only slowly. Thus by modifying the pressure a very refined gradation of the thickness of the ink layer can be obtained. The modification of the radius of the cylindrical surface of the dosing strip forming the dosing slot has a much bigger influence on the thickness of the ink layer, when the pushing pressure of the dosing strip 12 onto the inking roller 6 is maintained constant.

Thus the optimal radius can be used as a function of he hardness of the surface of the elastic packing of the inking roller 6 and the viscosity of the ink. The movement of the dosing strip 12 in the described fashions has no influence on the produced ink layer, since the geometrical relations in the dosing slot remain the same.

The experiments, furthermore, have shown that the dosing strip 12 is positioned preferably in approximately radial direction in relation to the inking roller 6.

Offset printing machines as well as printing machines can be equipped with such inking devices; printing machines which use a different printing technique, especially those working with a hard printing block.

While specific embodiments of the invention have been shown and described in detail to illustrate the application of the principles of the invention, it will be understood that the invention may be embodied otherwise without departing from such principles.

What is claimed is:

1. An inking device for a printing press having a stereo cylinder bearing a printing block, and an inking roller with an elastic surface which can be engaged with the stereo cylinder, comprising an inking device engaged with said inking roller and inking up said inking roller, a dosing device engaged with said inking roller, said inking device producing a pre-dosed ink layer on said inking roller, said dosing device being composed of at least one dosing strip member having an arcuate edge which forms an engagement area with said inking roller for wiping off a pre-dosed ink layer on the inking roller, leaving a selected quantity for transfer to the stereo cylinder, means permitting excess ink which is wiped off by said dosing strip to run off freely, mounting means mounting said dosing strip for pivotal movement about a pivotal axis parallel to a rotary axis of the inking roller with at least one part of the area of said dosing strip forming a dosing engagement with said inking device, moving means for effecting continuous to and fro movement of said dosing strip over about said pivotal axis for continuous self-cleaning purposes in substantially the directions of the circumference of said inking roller, so that continuously other arcuately adjacent area parts of said dosing strip are brought into engagement with said inking roller.

2. An inking device according to claim 1, including means mounting said dosing strip so that it is disposed substantially radially in respect to said inking roller.

3. An inking device according to claim 1, including means mounting said dosing strip for adjusting said dosing strip relative to the surface of said inking roller.

4. An inking device according to claim 1, wherein said dosing strip is pivotable, through an angle of from 5°–30°.

5. An inking device according to claim 1, wherein the arcuate edge of said dosing strip is in a substantially part-cylindrical form and that the pivotal axis of said dosing strip coincides with the axis of said part-cylindrical form.

6. An inking device according to claim 5 wherein said part cylindrical form of the dosing strip has a radius of 0.3–1.5 mm.

7. An inking device according to claim 1, wherein said mounting means comprises support walls and an eccentric bearing rotatable in said support walls and having an eccentric bore therethrough, at least one shaft mounting said dosing strip for rotation in the bore of said eccentric.

8. An inking device according to claim 1, wherein said dosing strip comprises a member having a surface which is cylindrical and turned away from said inking roller and surface having a constant spacing (R) to the pivotal axis of said dosing strip and being disposed swingable about the pivotal axis of said dosing strip.

9. An inking device according to claim 1, wherein said mounting means includes at least two guide rods which are connected at each one of their respective ends to said dosing strip at spaced locations including spaced-apart crank members connected to said guide rods to hold them in a parallel relationship, said moving means including a fluid-operated motor connected to at least one of said rods for moving said dosing strip to and fro.

10. An inking device according to claim 9, wherein said guide rods are mounted at spaced pivotal locations so that they move substantially parallel to said dosing strip and including a fluid motor having an extensible and retractable portion connected to one of said guide rods at its connection to one of said crank members.

11. An inking device according to claim 1, wherein said dosing strip comprises a member having an exchangeable protective coating thereon.

12. An inking device according to claim 11, wherein said protective coating comprises a supple plate extending over the engagement area of said dosing strip, means for holding one end of said plate to said dosing strip, and clamping means connected to the opposite end to clamp said plate in a stretch position over said dosing strip.

13. An inking device according to claim 1, wherein said dosing strip comprises a stationary support element forming an inking reservoir, said reservoir having a side facing said inking roller, the dosing strip being arranged alongside one side of said reservoir and defining an excessive ink guide slot therewith.

14. An inking device for printing presses which includes an inking roller having an elastic surface which is rotated in an ink supply to pick up a pre-dosed ink layer on said inking roller, comprising a dosing strip having an arcuate surface engageable with the surface of the inking roller, and means engageable with said dosing strip to continuously move the arcuate surface to and fro in engagement with the surface of the inking roller in opposite circumferential directions of said arcuate surface so as to continuously bring different arcuately adjacent surface area portions of said arcuate surface into engagement with the inking roller.

15. An inking device according to claim 14, wherein said engageable means comprises means for moving said dosing strip.

16. An inking device according to claim 14, including a cover member having opposite ends engaged over said dosing strip, means holding said cover member at its one end, and means biasing the opposite end in a direction to stretch it over said dosing strip.

17. An inking device according to claim 16, including a member pivotally mounted adjacent an end of said strip, turned away from said inking roller, a cover plate extending around said strip and engaged at each end with said pivotal member and means for pivoting said pivotal member to vary the position of said cover member on said strip.

18. A dosing device for an inking device of a printing press by which dosing device a pre-dosed ink-film on a resiliently surfaced ink roller can be reduced to the amount necessary for transfer to a printing cylinder, the dosing device comprising:

an inking roller having an elastic surface at least one dosing strip having a rounded arcuate edge providing an area for facing cooperation with a circumferential surface of the inking roller to form a dosing slot therewith;

means to mount the dosing strip at a fixed radial location adjacent the printing roller with the cooperating area facing the circumferential surface of the inking roller for pivotal movement about an axis parallel to a rotational axis of the inking roller;

and, means to continuously swivel the strip to and fro about the pivotal axis whereby new arcuately adjacent parts of the cooperating area of the rounded edge are constantly brought into facing cooperation with the inking roller to form the dosing slot.

19. A dosing device according to claim 18 wherein means are provided to adjust the width of the dosing slot.

20. A dosing device according to claim 18 in which the dosing strip has opposite longitudinal ends mounted on trunnions having rotational axes coincident with the pivotal axis, eccentric bushing means being provided for mounting the trunnions in a stationary frame.

* * * * *